US005409685A

United States Patent [19]

de Riese-Meyer et al.

[11] Patent Number: 5,409,685

[45] Date of Patent: Apr. 25, 1995

[54] MANUFACTURED TIN(II) SULFATE GRANULES FOR ELECTROLYTIC COLORING WITH METAL SALTS

[75] Inventors: Loert de Riese-Meyer, Duesseldorf; Hans-Josef Beaujean, Hilden; Jens Bode, Duesseldorf; Joerg Sander, Velbert; Volker Sander, Hilden, all of Germany

[73] Assignee: Henkel Kommanditgesellschaft auf Aktien, Duesseldorf, Germany

[21] Appl. No.: 167,838

[22] PCT Filed: Jun. 11, 1992

[86] PCT No.: PCT/EP92/01307

§ 371 Date: Dec. 20, 1993

§ 102(e) Date: Dec. 20, 1993

[87] PCT Pub. No.: WO93/00461

PCT Pub. Date: Jan. 7, 1993

[30] Foreign Application Priority Data

Jun. 20, 1991 [DE] Germany ..... 41 20 415.8

[51] Int. Cl.[6] ..... C01G 19/00

[52] U.S. Cl. ..... 423/544; 423/557; 205/105; 205/173; 205/253

[58] Field of Search ..... 205/105, 173, 252, 253, 205/300, 302, 303; 423/544, 95, 557

[56] References Cited

U.S. PATENT DOCUMENTS 5,064,512 11/1991 Brodalla et al. ..... 204/37.6

FOREIGN PATENT DOCUMENTS 0354365 2/1990 European Pat. Off. .
2384037 11/1978 France .
2025284 of 0000 Germany .
2428635 1/1975 Germany .
2609146 3/1976 Germany .
3246704 7/1983 Germany .
4034304 4/1992 Germany .
7120568 of 0000 Japan .
3101331 12/1972 Japan .
49-31614 8/1974 Japan .
6122637 10/1976 Japan .
6147436 12/1976 Japan .
7135841 11/1977 Japan .
53-18483 2/1978 Japan .
4097545 8/1979 Japan .
3285818 12/1991 Japan ..... 423/544
414194 6/1974 Russian Federation ..... 423/544
1482390 8/1977 United Kingdom .

OTHER PUBLICATIONS

S. A. Possoli, F. Tegiacchi; Korros. Korrosionsschutz Alum., Veranst. Eur. Foed. Korros., Vortr. 88 th 1976, 139–45 (no month).

*Primary Examiner*—John Niebling
*Assistant Examiner*—Edna Wong
*Attorney, Agent, or Firm*—Ernest G. Szoke; Wayne C. Jaeschke; Norvell E. Wisdom, Jr.

[57] ABSTRACT

A manufactured stannous sulfate granulate is suitable for electrolytically coloring anodized aluminum with metallic salts, where the granulate particles have a linear extension from 0.1 to 10 mm. Also disclosed are a process for manufacturing the same and using it for electrolytically coloring anodized aluminum with metallic salts. The manufactured stannous sulfate granulate is characterized by technical advantages, such as storage stability, easy dispensibility, and absence of dust, compared to conventionally used stannous sulfate powders.

20 Claims, No Drawings

MANUFACTURED TIN(II) SULFATE GRANULES FOR ELECTROLYTIC COLORING WITH METAL SALTS

FIELD OF THE INVENTION

This invention relates to manufactured tin(II) sulfate granules for the electrolytic coloring of anodized aluminum with metal salts, to a process for their production and to their use for the electrolytic coloring of anodized aluminum with metal salts.

STATEMENT OF RELATED ART

It is known that, on account of its base character, aluminum becomes covered with a natural oxide coating generally below 0.1 μm in thickness (Wernick, Pinner, Sheasby, *The Surface Treatment and Finishing of Aluminum and its Alloys*, ASM International).

Considerably thicker oxide coatings can be obtained by electrolytic oxidation of aluminum. This process is known as anodizing. Sulfuric acid, chromic acid or phosphoric acid is preferably used as the electrolyte. Organic acids, such as for example oxalic acid, maleic acid, phthalic acid, salicylic acid, sulfosalicylic acid, sulfophthalic acid, tartaric acid or citric acid, are also used in some processes.

However, sulfuric acid is the most commonly used electrolyte. Depending on the anodizing conditions, layer thicknesses of up to 150 μm can be obtained in this process. However, layer thicknesses of 20 to 25 μm are sufficient for external applications, such as for example facade facings or window frames.

The anodizing process is generally carried out in 10 to 20% sulfuric acid with a current density of 1.5 $A/dm^2$, at a temperature of 18° to 22° C. and over a period of 15 to 60 minutes, depending on the required layer thickness and the particular application.

The oxide coatings thus produced have a high absorption capacity for a number of organic and inorganic dyes.

Electrolytic coloring processes, in which anodized aluminum is colored by treatment with alternating current in heavy metal salt solutions, have been known since the middle of the thirties. The heavy metals used are, above all, elements of the first transition series, such as Cr, Mn, Fe, Co, Ni, Cu and, in particular, Sn. The heavy metal salts are generally sulfates, pH being adjusted to a value of 0.1 to 2.0 with sulfuric acid. The coloring process is carried out at a voltage of around 10 to 25 V and the resulting current density. The counter-electrode may either consist of graphite or stainless steel or of the same material which is dissolved in the electrolyte.

In this process, the heavy metal pigment is deposited in the pores of the anodic oxide coating in the half cycle of the alternating current in which aluminum is the cathode, the aluminum oxide coating being further thickened by anodic oxidation in the second half cycle. The heavy metal is deposited at the bottom of the pores and thus colors the oxide coating.

Tin salts in particular are used, colors varying from champagne via various bronze tones to black being obtained according to the procedure adopted.

However, one of the problems encountered where coloring is carried out in tin electrolytes is that the tin readily oxidizes so that basic tin(IV) oxide hydrates (stannic acid) are rapidly precipitated during the application and, in some cases, even during the storage of the Sn solutions. It is known that aqueous tin(II) sulfate solutions are oxidized to tin(IV) compounds simply by exposure to atmospheric oxygen. This is highly undesirable in the coloring of anodized aluminum in tin electrolytes because, on the one hand, it disrupts the process sequence (frequent renewal or topping up of the solutions rendered unusable by the formation of precipitates) and, on the other hand, leads to considerable extra costs because of the tin(IV) compounds which cannot be used for coloring. Accordingly, various processes have been developed, differing in particular in the means used to stabilize the generally sulfuric acid tin(II) sulfate solutions, for the electrolytic coloring of aluminum.

Phenol-like compounds, such as phenol sulfonic acid, cresol sulfonic acid or sulfosalicylic acid, are by far the most commonly used (S. A. Pozzoli, F. Tegiacchi; *Korros. Korrosionsschutz Alum., Veranst. Eur. Foed. Korros. Vortr.* 88th 1976, 139–45; JP-A-78 13583, 78 18483, 77 135841, 76 147436, 74 31614, 73 101331, 71 20568, 75 26066, 76 122637, 54 097545, 56 081598; GB-C-1,482,390).

Polyhydric phenols such as, for example, the diphenols hydroquinone, pyrocatechol and resorcinol (JP-A-58 113391, 57 200221; FR-C-23 84 037) and the triphenols phloroglycinol (JP-A-58 113391), pyrogallol (S. A. Pozzoli, F. Tegiacchi; *Korros. Korrosionsschutz Alum., Veranst. Eur. Foed. Korros., Vortr.* 88th 1976, 139–45; JP-A-58 113391; 57 200221) and gallic acid (JP-A-53 13583) have also been described in this connection.

Another significant problem in electrolytic coloring is so-called throwing power (depth throwing) which is understood to be the ability of a product to color anodized aluminum parts situated at different distances from the counter-electrode with a uniform color. Good throwing power is particularly important when the aluminum parts used are complicated in shape (coloring of depressions), when the aluminum parts are very large and when, for economic reasons, several aluminum parts have to be simultaneously colored in a single coloring process and medium color tones are to be obtained. In practice, therefore, high throwing power is highly desirable because faulty production is avoided and the optical quality of the colored aluminum parts is generally better. The process is made more economical by good throwing power because several parts can be colored in a single operation.

Throwing power is not the same as uniformity and a clear distinction has to be drawn between the two.

Although a coloring process may achieve high uniformity, it may still have poor throwing power; the reverse is also possible. In general, uniformity is only influenced by the chemical composition of the electrolyte, while throwing power is also dependent upon electrical and geometric parameters, such as for example the shape of the workpiece or its positioning and size.

DE-A-26 09 146 describes a process for coloring in tin electrolytes, in which throwing power is established through the particular circuit and voltage arrangement.

According to DE-A-20 25 284, the use of tin(II) ions by themselves reduces throwing power, particularly when tartaric acid or ammonium tartrate is added to improve conductivity.

DE-C-24 28 635 describes the use of a combination of tin(II) salts and zinc salts with addition of sulfuric acid and boric acid and also aromatic carboxylic and sulfonic acids (sulfophthalic acid or sulfosalicylic acid). Good throwing power is said to be obtained, in particular when the pH value is between 1 and 1.5. pH adjustment to 1–1.5 is a basic prerequisite for good electrolytic coloring; the pH value cannot be a deciding factor for a particular improvement in throwing power. There is no mention of whether the organic acids added have an effect on throwing power, nor is the throwing power achieved quantitatively described.

DE-C-32 46 704 describes a process for electrolytic coloring in which good throwing power is guaranteed by the use of special geometry in the coloring bath. In addition, cresol and phenol sulfonic acid, organic substances, such as dextrin and/or thiourea and/or gelatine, are said to guarantee uniform coloring.

In addition, European patent application EP-A-354 365 describes a process for the electrolytic coloring of anodized aluminum surfaces using metal salts, in which the antioxidants correspond to one of general formulae I to IV:

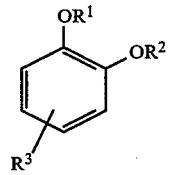

(I)

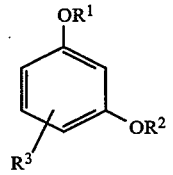

(II)

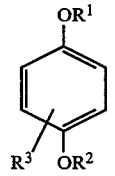

(III)

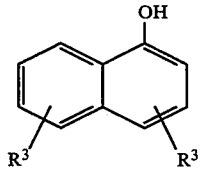

(IV)

in which $R^1$ and $R^2$ represent hydrogen, alkyl, aryl, alkylaryl, alkylaryl sulfonic acid containing 1 to 22 carbon atoms and alkali metal salts thereof and $R^3$ represents one or more hydrogen and/or alkyl, aryl, alkylaryl radicals containing 1 to 22 carbon atoms, at least one of the substituents $R^1$, $R^2$ and $R^3$ not being hydrogen, are used together with the throw improvers p-toluene sulfonic acid and/or naphthalene sulfonic acid. However, the throw improvers mentioned in this document lead during electrolysis to foul-smelling decomposition products.

In addition, German patent application P 40 34 304.9 describes a process for the electrolytic coloring of anodized aluminum surfaces with metal salts, in which a synergistic mixture of antioxidants corresponding to one of general formulae I to IV and throw improvers corresponding to general formula V:

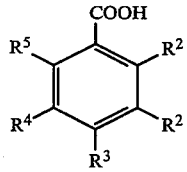

(V)

in which $WR^1$ to $R^5$ represent hydrogen, hydroxyl, carboxyl and/or sulfonic acid groups, is used.

Besides antioxidants and throw improvers, however, the most important constituent of the coloring baths is tin(II) sulfate. This salt accumulates as a finely crystalline substance during its production. This involves major problems from the applicational point of view. On the one hand, the powder-form product emits dust and is also difficult to dispense. On the other hand, oxidation products are formed in the event of prolonged storage. Besides the solid, concentrated aqueous solutions of tin(II) sulfate can also be obtained. Unfortunately, these solutions have the disadvantage of a small content of active substance per unit volume and, during their replenishment, the coloring baths are in danger of overflowing through the introduction of water.

DESCRIPTION OF THE INVENTION object of the Invention

Now, the problem addressed by the present invention was to provide an applicationally advantageous form for tin(II) sulfate for use in a tin(II)-containing sulfuric acid coloring bath for the a.c. coloring of anodized aluminum surfaces which would overcome the problems known from the prior art, such as guaranteeing lasting stability of the coloring bath, avoiding the oxidation of Sn(II) and, at the same time, guaranteeing good throwing power, in conjunction with easy dispensing of a storable tin(II) sulfate.

SUMMARY OF THE INVENTION

The problems stated above are solved by manufactured tin(II) sulfate granules for the electrolytic coloring of anodized aluminum surfaces with metal salts which are characterized in that they have a length of 0.1 to 10 mm.

Although granules and/or granulation are referred to hereinafter, the invention encompasses not only the irregularly shaped granules, but also microspheres, i.e. pellets, produced by shaping of the moist material in drums or on inclined rotating pans as well as cylindrical, rectangular solid or other particles of geometrically defined shape.

DESCRIPTION OF PREFERRED EMBODIMENT

The quantity of water to be added during granulation is, in particular, between 0.01 and 8% by weight and preferably between 1.0 and 2.5% by weight, based on the overall composition of the granules, to ensure that the particles adhere to one another. The moisture content of the tin(II) sulfate powder used for granulation has to be taken into consideration in this regard. In addition to the tin(II) sulfate, other ingredients of the granules, which will be discussed hereinafter, may also have to be taken into consideration in this regard. Accordingly, the final granules preferably contain 0.01 to 8% by weight and, more preferably, 1.0 to 2.5% by weight, of water.

Depending on the mask used in the granulating machine, the granules obtained are, for example, cylindrical or rectangular solid in shape and are cut to lengths of 0.1 to 10 mm. In one preferred embodiment of the invention, cylinders or rectangular solids with a height or edge length of 0.1 to 10 mm and, more particularly, 2 to 8 mm and a diameter or width of 0.8 to 2 mm and, more particularly, 0.9 to 1.5 mm are particularly preferred. Further aftertreatments, for example rounding of the edges to produce beads, may of course also be carried out within the scope of the present invention.

The present invention also relates to manufactured tin(II) sulfate granules as defined above additionally containing antioxidants known per se, throw improvers and/or other heavy metal salts. The advantage of introducing these compounds into the granules is that the desired constituents can always be subsequently introduced during the coloring process in an exact ratio determined in advance. Accordingly, in one preferred embodiment, manufactured tin(II) sulfate granules contain:

29.99 to 99.99% by weight of tin(II) sulfate,
0 to 10% by weight of antioxidants,
0 to 50% by weight of throw improvers,
0 to 30% by weight of heavy metal salts and
0.01 to 8% by weight of water, the percentage contents of the above-mentioned constituents of the granules adding up to 100% by weight.

In another preferred embodiment of the invention, the granules contain:

80 to 95% by weight and preferably 85 to 89% by weight of tin(II) sulfate,
0.5 to 2% by weight and preferably 1% by weight of antioxidants,
2 to 14% by weight and preferably 9 to 11% by weight of throw improvers and
0.5 to 3.5% by weight and preferably 1.0 to 2.5% by weight of water, the percentage contents of the above-mentioned constituents of the granules adding up to 100% by weight.

In another preferred embodiment of the invention, the antioxidants are selected from at least one compound corresponding to one of general formulae I to IV:

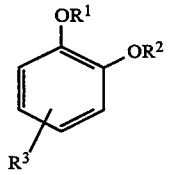

(I)

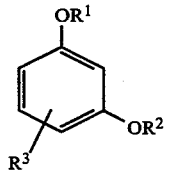

(II)

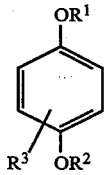

(III)

-continued

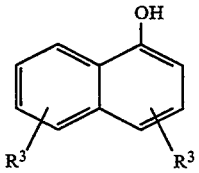

(IV)

in which $R^1$ and $R^2$ represent hydrogen, alkyl, aryl, alkylaryl, alkylaryl sulfonic acid, alkyl sulfonic acid containing 1 to 22 carbon atoms and alkali metal salts thereof and $R^3$ represents one or more hydrogen and/or alkyl, aryl, alkylaryl radicals containing 1 to 22 carbon atoms, at least one of the substituents $R^1$, $R^2$ and $R^3$ not being hydrogen.

According to the invention, throw improvers selected from at least one compound corresponding to general formula V:

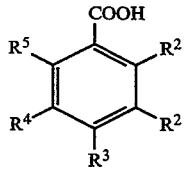

(V)

in which $R^1$ to $R^5$ represent hydrogen, hydroxyl, carboxyl and/or sulfonic acid groups, may also be used in the manufactured tin(II) granules.

A major advantage of the manufactured tin(II) sulfate granules according to the invention lies in the use of oxidation-stable water-soluble throw improvers. It is precisely in the event of prolonged operating times that the p-toluenesulfonic acid known from the prior art emits foul-smelling vapors through oxidation of the methyl group, and makes prolonged use of the coloring bath intolerable. According to the invention, therefore, it is important to introduce oxidation-stable functional groups, such as carboxyl, hydroxyl and/or sulfonic acid groups, into the throw improver where it is present. In addition, the functional groups mentioned guarantee the necessary solubility in water in contrast to other throw improvers widely used in the prior art.

According to the invention, 2-tert-butyl-1,4-dihydroxybenzene (tert-butyl hydroquinone), methyl hydroquinone, trimethyl hydroquinone, 4-hydroxy-2,7-naphthalene disulfonic acid and/or p-hydroxyanisole are preferably used as antioxidants corresponding to general formulae I to IV.

According to the invention, particularly suitable throw improvers corresponding to general formula V are 5-sulfosalicylic acid, 4-sulfophthalic acid, 2-sulfobenzoic acid, benzoic acid and/or benzenehexacarboxylic acid.

According to the invention, the tin(II) sulfate granules may also contain other heavy metal salts, preferably the salts and/or oxides of nickel, cobalt, copper, silver, gold and/or manganese which are soluble in sulfuric acid. If these heavy metals are used in the form of salts, the corresponding sulfates or nitrates arc particularly appropriate. Of the heavy metal ions mentioned, nickel and copper arc preferred for the purposes of the invention. The addition of nickel ions intensifies the coloring effect, i.e., a larger quantity of tin is deposited in the same unit of time. The addition of copper ions provides the typical tin colors with an optionally desirable red tone.

So far as the quantities of heavy metal ions used are concerned, it may be said that the sum total of the heavy metal ions, including tin, is preferably between 3 and 20 g/l and more preferably between 7 and 16 g/l For example, an electrolyte of the type in question contains 4 g/l of Sn(II) ions and 6 g/l of Ni(II) ions, both in the form of dissolved sulfate salts. An electrolyte such as this has the same coloring properties as an electrolyte containing only 10 g/l Sn(H). An advantage lies in the lower sensitivity of the electrolyte to oxidation through the smaller quantity of Sn(II).

The tin(II) sulfate granules manufactured in accordance with the invention may be obtained by thorough mixing of the constituents mentioned above and subsequent granulation, optionally with dissipation of the heat generated during granulation. The granulation/-pelleting operation should preferably be carried out at temperatures in the range from 10° to 70° C. In one particularly preferred embodiment, granulation is carried out at temperatures in the range from 40° to 60° C., in order largely to prevent oxidation during granulation.

The present invention also relates to the use of the manufactured tin(II) sulfate granules for the electrolytic coloring of aluminum surfaces with metal salts. A major advantage of the granules is that they are easy to add to the sulfuric acid coloring baths in measured quantities. By addition of the granules, all the important constituents for the effective electrolytic coloring of anodized aluminum surfaces are simultaneously added to the dilute sulfuric acid in optimal quantity ratios and in a readily soluble form. The quantity of granules per liter coloring bath is determined by the desired bath concentrations. However, if the tin(II) sulfate granules do not contain any or all of the additional additives mentioned above, such as antioxidants, throw improvers and/or heavy metal salts, it is of course possible in accordance with the invention to introduce such additives into the coloring bath in addition to the granules.

Coloring is normally carried out with a tin(II) sulfate solution containing approximately 3 to 20 g and preferably 7 to 16 g of tin per liter. The coloring process is preferably carried out at a pH value of 0.1 to 2.0 and, more particularly, at a pH value of 0.35 to 0.5, corresponding to 16 to 22 g sulfuric acid per liter, at a temperature in the range from about 14° to 30° C. The a.c. voltage or the a.c. voltage (50 to 60 Hz) superimposed on direct current is preferably adjusted to a value of 10 to 25 V and, more preferably, to a value of 15 to 18 V with an optimum of the order of 17 V.

In the context of the invention, the expression "alternating current superimposed on direct current" is the same as direct current superimposed on alternating current. The figure shown is always the terminal voltage. Coloring begins at a resulting current density of generally about 1 A/dm$^2$ which then falls to a constant value of 0.2 to 0.5 A/dm$^2$. The color tones obtained, which can vary from champagne through various bronze tones to black, differ according to the voltage, the metal concentration in the coloring bath and the immersion times.

The manufactured tin(II) sulfate granules are further distinguished by very good solubility in dilute sulfuric acid, by the absence of dust and by excellent stability in storage.

EXAMPLES

A) Production of pelleted tin(II) sulfate granules

The formulation ingredients (see Table) of Examples 1 to 7 were premixed for 30 s in 2 to 5 kg batches in a 5 liter plowshare mixer (for example a Lödige mixer). Water was then added (30 s), the aftermixing time being 60 s. The premix was then pelleted with no further aftertreatment. No coarse particles occurred while fine particles and debris were removed by sieving. The product is ready to use after sieving. The suitable circulation of cooling water and/or a suitable temperature of the cooling water ensured that the product temperature did not exceed 45° C. during the pelleting process. The particular feature of the pelleting press used (Schlüter type PP 127–3.0) is its thermostatically cooled runner. The machine was operated at an r.p.m. setting of about 75%. The cylindrical pellets obtained had a length of 2 to 5 mm and a diameter of about 1 mm.

B) Testing of the coloring bath properties

The pellets according to Examples 1 to 7 were added to the sulfuric acid (20 g/l) in such a quantity that an Sn(II) concentration of 10 g/l was obtained.

Sample plates of the DIN material A1 99.5 (No. 3.0255) were conventionally pretreated (degreased, pickled, descaled) and anodized for 60 minutes by the DC

TABLE

| Example | 1 | 2 | 3 | 4 | 5 | 6 | 7 |
|---|---|---|---|---|---|---|---|
| Composition of the granules (% by weight): | | | | | | | |
| Tin(II) sulfate | 87.4 | 82.6 | 46.0 | 67.6 | 84.2 | 99.0 | 97.4 |
| t-Butyl hydroquinone | 1.0 | 1.8 | 13.1 | — | 0.9 | — | 1.1 |
| Sulfosalicylic acid | 9.6 | 14.3 | 39.4 | 29.9 | — | — | — |
| Methyl hydroquinone | — | — | — | 1.1 | — | — | — |
| Benzenehexacarboxylic acid | — | — | — | — | 14.0 | — | — |
| Water | 2.0 | 1.3 | 1.5 | 1.4 | 0.9 | 1.0 | 1.5 |
| Concentration used for 10 g/l Sn(II): | 20.5 | 21.9 | 39.34 | 26.8 | 21.5 | 18.1 | 18.1 |
| Composition of the coloring bath (g/l): | | | | | | | |
| Sulfuric acid | 20.0 | 20.0 | 20.0 | 20.0 | 20.0 | 20.0 | 20.0 |
| Tin(II) | 10.0 | 10.0 | 10.0 | 10.0 | 10.0 | 10.0 | 10.0 |
| t-Butyl hydroquinone | 0.2 | 0.4 | 5.15 | — | 0.2 | — | 0.2 |
| Sulfosalicylic acid | 2.0 | 3.1 | 15.5 | 8.0 | — | — | — |
| Methyl hydroquinone | — | — | — | 0.3 | — | — | |
| Benzenehexacarboxylic acid | — | — | — | — | 3.0 | — | — |
| Bath stability | 1 | 1 | 1 | 1 | 1 | 5 | 1 |
| Coloring result 15 V, 5 mins. | 1 | 1 | 1 | 1 | 1 | 5 | 5 |

process (=direct current/sulfuric acid process, 200 g/l sulfuric acid, 10 g/l Al(III), throughput of air, 1.5 A/dm$^2$, 18° C.). A layer approximately 20 μm thick was built up. The plates thus pretreated were then colored in the prepared coloring baths for 15 minutes using 15 V alternating current (50 Hz).

The coloring result and bath stability were compared with color finishes of electrolytes obtained by successive addition of the individual active substances to the dilute sulfuric acid. Scoring: 1=very good, 6=inadequate. There were no differences in Examples 1 to 5. Although good granules were obtained in Examples 6 and 7, they did not produce the required results in regard to bath stability and coloring due to the absence of additives. In these cases, the corresponding additives, i.e., antioxidant and throw improver, may be separately added to the coloring bath if desired.

The invention claimed is:

1. Tin(II) sulfate-contained granules for the electrolytic coloring of anodized aluminum surfaces with metal salts, which are manufactured by agglomerating moist solid tin(II) sulfate in drums or on inclined rotating pans and which have a length of 0.1 to 10 mm.

2. Tin(II) sulfate-containing granules as claimed in claim 1, which contain 1.0 to 2.5% by weight of water, based on the overall composition of the granules.

3. Tin(II) sulfate-containing granules as claimed in claim 2, which are in the form of cylinders or rectangular solids with a height or edge length of 2 to 8 mm and a diameter or width of 0.9 to 1.5 mm.

4. Tin(II) sulfate-containing granules as claimed in claim 3, which contain antioxidants, throw improvers, other heavy metal salts, or any two or more thereof.

5. Tin(II) sulfate-containing granules as claimed in claim 4, which contain:

29.99 to 99.99% by weight of tin(II) sulfate,
up to 10% by weight of antioxidants,
up to 50% by weight of throw improvers,
up to 30% by weight of heavy metal salts and
0.01 to 8% by weight of water, the percentage contents of the above-mentioned constituents of the granules adding up to 100% by weight.

6. Tin(II) sulfate-containing granules as claimed in claim 5, which contain:

85 to 89% by weight of tin(II) sulfate,
1% by weight of antioxidants,
9 to 11% by weight of throw improvers and
1.0 to 2.5% by weight of water, the percentage contents of the above-mentioned constituents of the granules adding up to 100% by weight.

7. Tin(II) sulfate-containing granules as claimed in claim 6, which contain at least one of:

a) antioxidants selected from at least one compound corresponding to one of general formulae I to IV:

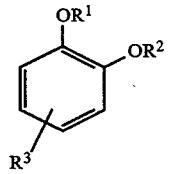

(I)

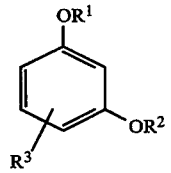

(II)

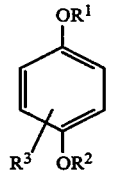

(III)

-continued

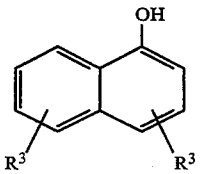

(IV)

in which $R^1$ and $R^2$ represent hydrogen, alkyl, aryl, alkylaryl, alkylaryl sulfonic acid, alkyl sulfonic acid containing 1 to 22 carbon atoms and alkali metal salts thereof and $R^3$ represents one or more hydrogen or alkyl, aryl, or alkylaryl radicals containing 1 to 22 carbon atoms, at least one of the substituents $R^1$, $R^2$ and $R^3$ not being hydrogen, and b) throw improvers selected from at least one compound corresponding to general formula V:

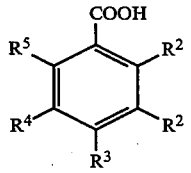

(V)

in which $R^1$ to $R^5$ represent hydrogen, hydroxyl, carboxyl or sulfonic acid groups.

8. Tin(II) sulfate-containing granules as claimed in claim 7, which contain at least one compound selected from the group consisting of 2-tert-butyl-1,4-dihydroxybenzene (tert-butyl hydroquinone), methyl hydroquinone, trimethyl hydroquinone, 4-hydroxy-2,7-naphthalene disulfonic acid and p-hydroxyanisole as antioxidant or at least one compound selected from the group consisting of 5-sulfosalicylic acid, 4-sulfophthalic acid, 2-sulfobenzoic acid, benzoic acid and benzenehexacarboxylic acid as throw improver.

9. Tin(II) sulfate-containing granules as claimed in claim 8, which contain other coloring heavy metal pigments selected from salts and oxides of nickel, cobalt, copper, silver, gold and manganese that are soluble in sulfuric acid.

10. Tin(II) sulfate-containing granules as claimed in claim 1, which contain 0.01 to 8% by weight of water, based on the overall composition of the granules.

11. Tin(II) sulfate-containing granules as claimed in claim 1, which are in the form of cylinders or rectangular solids with a height or edge length of 0.1 to 10 mm and a diameter or width of 0.8 to 2 mm.

12. Tin(II) sulfate-containing granules as claimed in claim 1, which contain antioxidants, throw improvers, other heavy metal salts, or any two or more thereof.

13. Tin(II) sulfate-containing granules as claimed in claim 1, which contain:

29.99 to 99.99% by weight of tin(II) sulfate,
0 to 10% by weight of antioxidants,
0 to 50% by weight of throw improvers,
0 to 30% by weight of heavy metal salts and
0.01 to 8% by weight of water, the percentage contents of the above-mentioned constituents of the granules adding up to 100% by weight.

14. Tin(II) sulfate-containing granules as claimed in claim 13, which contain:

80 to 95% by weight of tin(II) sulfate,
0.5 to 2% by weight of antioxidants,
2 to 14% by weight of throw improvers and 0.5 to 3.5% by weight of water.

15. Tin(II) sulfate-containing granules as claimed in claim 4, which contain at least one of:

a) antioxidants selected from at least one compound corresponding to one of general formulae I to IV:

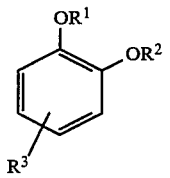

(I)

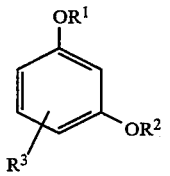

(II)

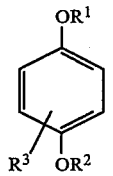

(III)

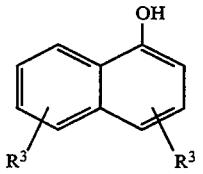

(IV)

in which $R^1$ and $R^2$ represent hydrogen, alkyl, aryl, alkylaryl, alkylaryl sulfonic acid, alkyl sulfonic acid containing 1 to 22 carbon atoms and alkali metal salts thereof and $R^3$ represents one or more hydrogen or alkyl, aryl, or alkylaryl radicals containing 1 to 22 carbon atoms, at least one of the substituents $R^1$, $R^2$ and $R^3$ not being hydrogen, and b) throw improvers selected from at least one compound corresponding to general formula V:

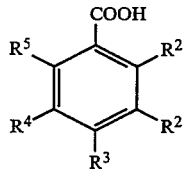

(V)

in which $R^1$ to $R^5$ represent hydrogen, hydroxyl, carboxyl or sulfonic acid groups.

16. Tin(II) sulfate-containing granules as claimed in claim 4, which contain at least one compound selected from the group consisting of 2-tert-butyl-1,4-dihydroxybenzene (tert-butyl hydroquinone ), methyl hydroquinone, trimethyl hydroquinone, 4-hydroxy-2,7-naphthalene disulfonic acid and p-hydroxyanisole as antioxidant or at least one compound selected from the group consisting of 5-sulfosalicylic acid, 4-sulfophthalic acid, 2-sulfobenzoic acid, benzoic acid and benzenehexacarboxylic acid as throw improver.

17. Tin(II) sulfate-containing granules as claimed in claim 4, which contain other coloring heavy metal pigments selected from salts and oxides of nickel, cobalt, copper, silver, gold and manganese that are soluble in sulfuric acid.

18. A process of electrolytically coloring anodized aluminum by treatment with alternating current in an electrolyte solution containing heavy metal pigment, wherein the improvement comprises utilizing, as at least part of the heavy metal pigment, tin(II) sulfate-containing granules according to claim 1.

19. A process as claimed in claim 18, wherein the electrolyte solution contains sulfuric acid and from 3 to 20 g/l of tin(II) ions.

20. A process as claimed in claim 19, wherein the electrolyte solution has a pH in the range from 0.35 to 0.5 and contains from 16 to 22 g/l of sulfuric acid, and the process is performed at 14° to 30° C. with a 50 to 60 Hz a.c. voltage, or a.c. imposed on direct voltage, of 15 to 18 V.

* * * * *